United States Patent [19]

Hahn et al.

[11] Patent Number: 4,509,425

[45] Date of Patent: Apr. 9, 1985

[54] ARRANGEMENT FOR ADJUSTING THE CYLINDERS IN ROTARY PRINTING PRESSES

[75] Inventors: Ulrich Hahn, Taura; Peter Straube, Radebeul; Michael Koch, Taucha, all of German Democratic Rep.

[73] Assignee: VEB Kombinat Polygraph "Werner Lamberz" Leipzig, Leipzig, German Democratic Rep.

[21] Appl. No.: 526,162

[22] Filed: Aug. 24, 1983

[30] Foreign Application Priority Data

Aug. 24, 1982 [DD] German Democratic Rep. ... 242747

[51] Int. Cl.[3] ..... B41F 13/20; B41F 31/34; B41L 27/36

[52] U.S. Cl. ..... 101/216; 101/247

[58] Field of Search ..... 101/247, 216, 218, 348, 101/349, 352, DIG. 10, 375, 137, 139, 140, 143, 144, 145, 136, 141, 174, 182, 184, 185, 148

[56] References Cited

U.S. PATENT DOCUMENTS

| | | | |
|---|---|---|---|
| 796,212 | 8/1905 | Horsell | 101/348 |
| 965,160 | 7/1910 | Cullman | 101/DIG. 10 |
| 1,017,517 | 2/1912 | Dodd | 101/DIG. 10 |
| 1,040,012 | 10/1912 | Raabe | 101/216 |
| 1,338,347 | 4/1920 | Wood | 101/216 |
| 2,801,584 | 8/1957 | Davidson | 101/216 |
| 3,783,780 | 1/1974 | Saueressig | 101/216 X |

*Primary Examiner*—J. Reed Fisher

*Attorney, Agent, or Firm*—Michael J. Striker

[57] ABSTRACT

An arrangement for adjusting the cylinders in a rotary printing press, in particular the distance between the two cylinder axes of the corresponding cylinders has a first roller ring which is arranged centrically with respect to the one of the cylinder axes of the respective one of the cylinders and a second roller ring radially movable and being arranged on the other cylinder. The second roller ring cooperates with the first roller ring and defines a bore hole of a predetermined diameter. A conical bushing is provided for supporting the second roller ring in the other cylinder and is axially movable with respect thereto so as to adjust the distance between the two cylinder axes. The conical bushing has a largest diameter which is still smaller than the diameter of the bore hole.

5 Claims, 2 Drawing Figures

ARRANGEMENT FOR ADJUSTING THE CYLINDERS IN ROTARY PRINTING PRESSES

BACKGROUND OF THE INVENTION

The invention relates to an arrangement for adjusting the cylinders in rotary printing presses, and in particular for adjusting the distance of two cylinder axles between two corresponding cylinders for processing of sheet-like and web-like material with different paper thicknesses.

A modification of the cylinder axles distance must be obtained for processing different paper thicknesses in order to maintain constant the printing pressure at each paper thickness.

In known rotary printing presses, roller rings are arranged at the front ends of the two cylinders. The rollers rings are kept under a certain pre-tension which is higher than the printing pressure and roll on each other in pairs. In these arrangements, a modification of the cylinder axles distance, and of the printing gap between the cylinders is only possible through modification of the printing layer thickness. This, however, is disadvantageous as a change of the printing layer prior to each new application is uneconomical.

The DD-PS No. 92,943 discloses an arrangement for changing the printing gap in which the barrel rings of smaller diameter are supported by the end faces of the cylinder via a roller ring which in vicinity of a cylinder center by means of an eccentric approximately maintains constant the pre-tension of the barrel rings parallel to the change of the printing gap via a correcting gearing.

This arrangement has, however, the disadvantage that the forces introduced outside of the cylinder centers are essentially larger than the required pre-tension, and consequently leads to an unnecessary loading of the structural unit. Moreover, a modification of the printing gap does not guarantee a uniform printing pressure.

SUMMARY OF THE INVENTION

It is the general object of the present invention to avoid the prior-art disadvantages.

In particular, it is an object of the invention to provide an arrangement for adjusting the cylinders in a rotary printing press, which guarantees the roller ring contact with low forces so as to prevent a radial movement of the cylinders in the channel passage.

Yet another object of the invention is to provide an arrangement for adjusting the cylinders in a rotary printing press which permits the processing of different material thicknesses without changing the printing layer thicknesses.

Still another object of the present invention is to provide an arrangement for adjusting the cylinder axles distance between two cylinders which guarantees a constant roller ring pressure at simultaneous radial adjustment of the cylinders for processing of sheet-like and web-like materials.

In keeping with these objects and with others which will become apparent hereinafter, one feature of the invention resides in an arrangement for adjusting the distance between two cylinders having axles in a rotary printing press, the arrangement comprising a first roller ring arranged fixedly on and centrically to the axle of one of the cylinders, a second roller ring radially movable and being arranged on the other cylinder, the second roller ring defining a bore hole having a diameter and cooperating with the first roller ring, and a conical bushing projecting through the bore hole and supporting the second roller ring in the other cylinder, the bushing being axially movable with respect to the other cylinder axis so as to radially move the second roller and adjust the distance between the two cylinders. Preferably, the bushing has a largest diameter which is smaller than the diameter of the bore hole of the second roller ring.

According to another feature of the present invention, the first roller ring and the second roller ring have a diameter corresponding to the respective diameters of the cylinders.

Through the arrangement according to the invention, the roller ring contact is secured with low forces and consequently a radial movement of the cylinders during the channel passage is prevented. Moreover, the inventive arrangement permits a processing of different materials without changing the printing layer thickness and the adjustment of the cylinder axles distance between two cylinders with simultaneous radial displacement of the cylinder while maintaining constant the roller ring pressing.

The novel features which are considered characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
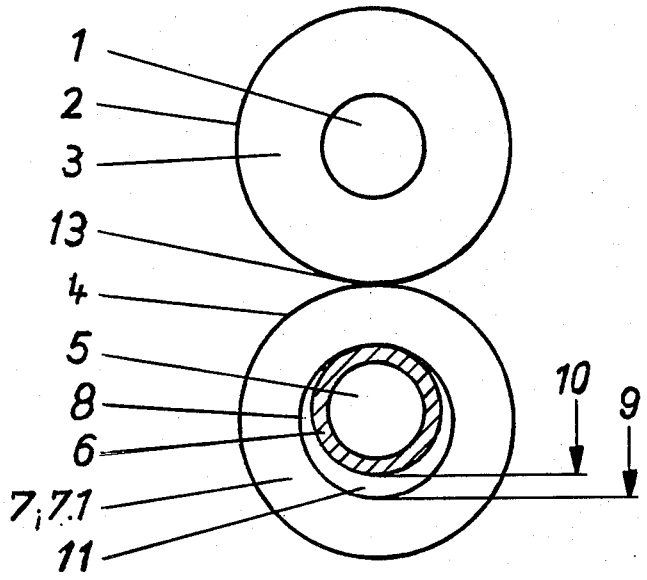
FIG. 1 is a side view of a cylinder arrangement.
Figure 2:
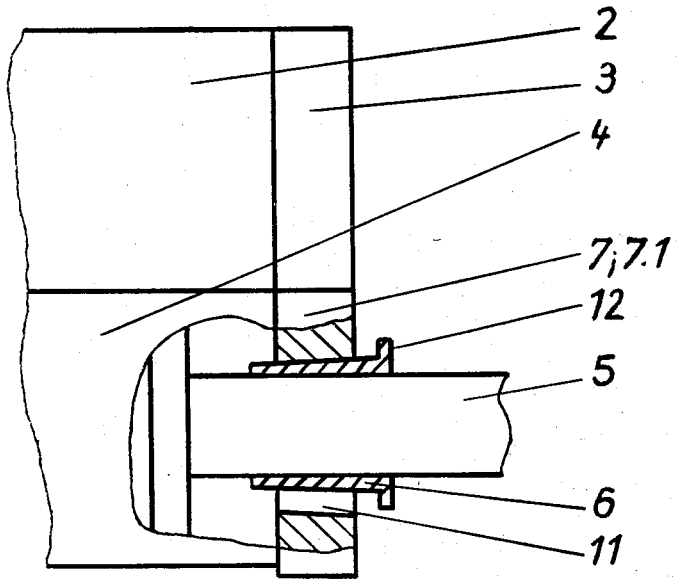
FIG. 2 is a section of a front view of the cylinder arrangement according to FIG. 1.

FIG. 1 shows a first cylinder 2 provided with a cylinder journal 1 on which a first roller ring 3 is centrically arranged. The diameter of the first roller ring 3 corresponds to the diameter of the first cylinder 2. The second cylinder 4, which cooperates with the first cylinder 2, is provided with a journal 5 on which a conical bushing 6 is supported which is axially movable but fixed against rotation. The conical bushing 6 has a tapering directed to the second cylinder 4 and supports a second roller ring 7.1 developed as outer ring 7. The roller ring 7.1 has a centrical and conically shaped bore hole 8 which has an inclination corresponding to the inclination of the conical bushing 6. The conical bore hole 8 is provided with a diameter 9 larger as the largest diameter 10 of the conical bushing 6. The second roller ring 7.1, which is arranged on the conical bushing 6, is radially movable but fastened in axial direction by not shown stop members.

On the side of the journal 5, which side is opposing the contact spot 13 of both roller rings 3, 7.1, a gap 11 having a size of at least some tenths of a millimeter is defined between the conical bore hole 8 and the conical bushing 6.

At the largest diameter of the conical bushing 6, there is a collar 12 which prevents a force-locking between the conical bushing 6 and the second roller ring 7.1 and therefore guarantees the required gap 11. A changing of the cylinder axis distance between the cylinders 2 and 4 at constant roller ring pressure is obtained through parallel adjustment of the roller ring 7.1 simultaneous to the cylinder adjustment. This is achieved by axially moving the conical bushing 6 through known not shown gearings. The axial displacement of the conical bushing 6 causes a straight line displacement of the roller ring 7.1 along the connecting line between the centers of the cylinders 2, 4.

The gearing which is not shown and causes the displacement of the conical bushing 6 is dimensioned so that a gearing member acts with changeable functional dimension thereby influencing the transmission function in order to adjust the pressing between the roller rings during the assembly.

A further possibility for the displacement of the conical bushing 6 can be provided through known gearing members of a separate adjusting device fixed to the housing. The adjusting device can be driven mechanically, hydraulically, electrically or pneumatically.

It will be understood that each of the elements described above, or two or more together, may also find a useful application in other types of arrangement for adjusting the cylinders in a rotary printing press differing from the types described above.

While the invention has been illustrated and described as embodied in an arrangement for adjusting the cylinders in a rotary printing press, it is not intended to be limited shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An arrangement for adjusting the distance between two cylinders having axles in a rotary printing press for printing on materials of different thicknesses, the arrangement comprising:

a first roller ring arranged fixedly on and centrically to the axle of the one of the cylinders;

a second roller ring arranged on the other cylinder, the second roller ring defining a bore hole having a diameter and cooperating with the first roller ring; means for mounting the second roller ring for radial movement and means for maintaining a constant printing pressure of the cylinders during printing of different material thicknesses and including a conical bushing projecting through the bore hole and supporting the second roller ring in the other cylinder, and means for mounting the conical bushing for axial movement with respect to the other cylinder axis so as to radially move the second roller ring and to adjust the distance between the two cylinders so as to maintain, during printing on materials of different material thicknesses, a constant printing pressure at each material thickness.

2. An arrangement as defined in claim 1, wherein the conical bushing has a largest diameter, the diameter of the bore hole of the second roller ring being greater than the largest diameter of the conical bushing.

3. An arrangement as defined in claim 1, wherein the bore hole is of conical shape and has an inclination and wherein the conical bushing has an inclination, the inclination of the bore hole being equal to the inclination of the bushing.

4. An arrangement as defined in claim 1, wherein the first roller ring has a diameter corresponding to the outer diameter of the associated cylinder and the second roller ring has a diameter corresponding to the outer diameter of the associated other cylinder.

5. An arrangement as defined in claim 1, and further comprising a gearing for axially moving the conical bushing.

* * * * *